US012478122B2

(12) United States Patent
Koos

(10) Patent No.: US 12,478,122 B2
(45) Date of Patent: Nov. 25, 2025

(54) PERSONAL PROTECTION GOWN WITH FRONTAL COVERAGE

(71) Applicant: Koos Medical Innovations LLC, Ankeny, IA (US)

(72) Inventor: Margaret Koos, Ankeny, IA (US)

(73) Assignee: Koos Medical Innovations LLC, Ankeny, IA (US)

( * ) Notice: Subject to any disclaimer, the term of this patent is extended or adjusted under 35 U.S.C. 154(b) by 0 days.

(21) Appl. No.: 18/787,284

(22) Filed: Jul. 29, 2024

(65) Prior Publication Data

US 2024/0381957 A1 Nov. 21, 2024

Related U.S. Application Data

(63) Continuation of application No. 17/932,045, filed on Sep. 14, 2022, now Pat. No. 12,070,087.

(51) Int. Cl.
*A41D 13/12* (2006.01)
*A41D 27/18* (2006.01)

(52) U.S. Cl.
CPC ..... *A41D 13/1209* (2013.01); *A41D 27/18* (2013.01)

(58) Field of Classification Search
CPC ..... A41D 13/1209; A41D 13/12; A41D 13/1218; A41D 13/1245; A41D 13/04; A41D 27/18; A41D 13/0512; A41D 13/1161; A41D 13/1263; A41D 23/00;
(Continued)

(56) References Cited

U.S. PATENT DOCUMENTS 278,758 A * 6/1883 Weatherly ..... A41D 27/18 2/133
895,510 A * 8/1908 Snellenburg ..... A41D 13/129 2/114

(Continued)

FOREIGN PATENT DOCUMENTS

DE 202020101977 U1 4/2020
IT 202000010441 A1 * 11/2021

OTHER PUBLICATIONS

English translation of IT-202000010441-A1 (Citterio) Doc pub Nov. 2021. (Year: 2021).*

(Continued)

*Primary Examiner* — Amy Vanatta
(74) *Attorney, Agent, or Firm* — Erise IP, P.A.

(57) ABSTRACT

Systems, methods, and devices include a personal protection gown to provide frontal protection for the user. The personal protection gown includes a neck protector extending from a front neckline of a body portion of the personal protection gown. The neck protector partially couples to the front neckline such that a separation gap between the neck protector and the body portion is formed (e.g., on either side of the partial coupling and around the back of the neck). Extension straps of the neck protector are pulled around a neck of the user and form a knot to secure the neck protector and the personal protection gown in place. The separation gap provides flexibility in how tightly the neck protector is pulled such that the personal protection gown effectively provides zone A coverage (e.g., as defined by the Association for the Advancement of Medical Instrumentation (AAMI) for different body shapes and sizes.

20 Claims, 5 Drawing Sheets

(58) Field of Classification Search
CPC ..... A41D 2300/33; A41B 1/12; A41B 3/04; A41B 13/10; A41B 3/00; A45D 44/08
USPC ... 2/50, 51, 52, 49.1, 49.2, 48, 114, 91, 116, 2/468
See application file for complete search history.

(56) References Cited

U.S. PATENT DOCUMENTS 1,506,332 A * 8/1924 Bloom ..... A41B 13/10 2/48
2,114,922 A * 4/1938 Glasmann ..... A41D 13/04 D3/25
2,174,694 A * 10/1939 Elson ..... A41B 13/103 D2/864
2,544,487 A * 3/1951 Caluthis ..... A45D 44/08 2/50
2,563,687 A * 8/1951 Metzger ..... A41D 27/18 2/116
2,654,092 A * 10/1953 Brennish ..... A45D 44/08 2/50
3,213,464 A * 10/1965 Lewis ..... A41D 13/04 2/50
3,729,747 A * 5/1973 Belkin ..... A41D 13/1209 2/114
5,033,115 A * 7/1991 Bowling ..... A41D 19/0055 2/48
5,410,758 A * 5/1995 Dupont ..... A41D 13/1209 2/901
5,414,867 A * 5/1995 Bowling ..... A41D 13/1209 2/46
6,418,559 B1 * 7/2002 Wrecsics ..... A41D 13/11 2/127
D673,757 S * 1/2013 Uruburo ..... D2/861
2001/0034891 A1 * 11/2001 Matsushita ..... A41D 13/1245 2/129
2007/0022509 A1 * 2/2007 Bloom ..... A41B 13/10 2/49.1
2014/0367594 A1 * 12/2014 Reynolds ..... A41D 27/18 250/516.1
2019/0150534 A1 * 5/2019 Jascomb ..... A41D 27/18
2022/0047018 A1 2/2022 Koos
2022/0087335 A1 * 3/2022 Lorenz ..... A41D 27/18
2022/0346473 A1 * 11/2022 Tsuei ..... A41D 13/1161
2024/0081431 A1 * 3/2024 King ..... A41B 3/14

OTHER PUBLICATIONS

McKesson, Cleanroom Gown X-Large White Sterile Not Rated Disposable, Gown, Clean Room Anti-Static STR Velcro CLSR WHT XLG (SO/CS), # 1136406, Retrieved from the Internet: https://mms.mckesson.com/product/1136406/TrueCare-Biomedix-TCBA40ST-XL.
McKesson, Protective Procedure Gown Large Blue NonSterile Disposable, Gown, ISO Thumb Loop BLU LG (10BX 10BX/CS), #788570, Retrieved from the Internet: https://mms.mckesson.com/product/788570/welmed-9100-260I?utm_campaign=mck+search+results&utm_source=mckesson.com&utm_medium=referral.
PCT Patent Application PCT/US2023/32056 International Preliminary Report on Patentability issued Mar. 27, 2025.
Truecare Biomedix, Sterile Lab Gown, TCBA40ST, Retrieved from the Internet: chrome-extension://efaidnbmnnnibpcajpcglclefindmkaj/https://www.pharma-choice.com/stage/wp-content/uploads/2022/10/TCBA40ST-Sterile-Lab-Gown.pdf.
Welmed, Disposable Product Portfolio for Organ, Tissue & Biologics Industries, www.welmed.us, pp. 1-10.

* cited by examiner

PERSONAL PROTECTION GOWN WITH FRONTAL COVERAGE

RELATED APPLICATION

This application is a continuation of U.S. patent application Ser. No. 17/932,045, filed Sep. 14, 2022, the disclosures of which is incorporated herein by reference in its entirety.

BACKGROUND

Healthcare workers are frequently at risk of acquiring infections while providing patient care. For instance, front-line healthcare workers have a nearly 12-times higher risk of contracting COVID-19 compared with individuals in the general community, and those with inadequate access to personal protective equipment (PPE) are at even higher risk. PPE is defined as an item of clothing that is specifically designed and constructed for the purpose of isolating all or part of the body from a potential hazard or isolating the external environment from contamination by the wearer of the clothing. PPE includes gloves, gowns and eye and mouth protection and is the first line of protection for health care personnel as they care for patients with communicable diseases.

Gowns are the second most used PPE in healthcare, after gloves, to protect clothing from being contaminated. Studies have shown clothing contaminated with infectious particles can be a source of transmission of disease to the wearer (self-inoculation) and to those around them. Clothing can become contaminated with infectious microorganisms by direct contact with body secretions or fluids, contact with soiled hands, contact with aerosolized droplets generated via talking, sneezing, coughing, vomiting, and aerosolizing medical treatments or procedures (such as nebulized breathing treatments and intubation). Accordingly, gowns are classified by their intended use, for instance, as surgical or non-surgical, and as isolation or non-isolation. Surgical gowns are regulated by the Food and Drug Administration (FDA) as a Class II medical device that requires a 510(k) premarket notification, and non-surgical gowns are regulated as Class I devices. However, non-surgical gowns are also isolation gowns and, as such, have the same, larger critical zone areas as surgical isolation gowns.

Furthermore, all healthcare personnel and visitors must don a new gown each time they enter an isolation room. These gowns are used in both hospital and clinical settings. At a given hospital, 6,000 or more isolation gowns can be used per day. That's over two million disposable gowns used by one hospital annually and these numbers increase significantly during viral respiratory illness outbreaks such as the COVID-19 pandemic. There are over 6,000 hospitals and 34,000 ambulatory medical clinics in the United States.

Such enormous quantities of gowns used makes it necessary to manufacture them in bulk. It is most economical for medical facilities purchasing millions of these gowns annually to purchase one size. As such, most disposable, non-surgical gowns are a universal, "one-size-fits-all." Others are offered in large and extra-large sizes only.

There are significant consequences to providing only one or two sizes of non-surgical gowns. The voluminous size is a poor fit for most wearers which leads to the upper front torso region coverage being compromised. Disposable, non-surgical gowns are very large to accommodate all the different sized wearers, both male and female. As such, these gowns do not hang straight down, but frequently gather and bunch due to the extra material. The opening at the top of the gown has a large circumference that allows the top of the gown at critical zone A (including the upper front torso region) to lay, not at the base of the neck as required, but lower on the chest or off to the side. These gowns are frequently donned in haste when heading into an emergency which can exacerbate the poor fit.

Even if critical zone A is covered when the gown is initially donned, providing patient care is not a stationary task. As the healthcare worker moves about, often leaning over, the gown's extra material bunches and shifts. This pulls the neckline forward and/or down, exposing the chest area of critical zone A. This is a mechanism of failure of the disposable, non-surgical gown's inability to maintain critical zone A protection in real-world settings.

Failure to protect the upper area of critical zone A risks contamination from infectious microorganisms, especially those transported via droplets, such as respiratory viruses, including COVID-19. Infectious respiratory droplets are generated via talking, sneezing, coughing, vomiting, and aerosolizing medical treatments or procedures (such as nebulized breathing treatments and intubation). These droplets are produced while a healthcare worker is close to the patient, providing care. When the scrub top is exposed, the droplets can land on it, contaminating the top and making it a potential source of infection.

The contamination of the front of a scrub top is of particular concern for self-inoculation at the end of the shift when the health care worker removes their scrub top. Scrub tops are form fitting and removed by being pulled over the head. As the wearer pulls the top over their head, the exact area that has been exposed throughout their shift and potentially contaminated is brought into direct contact with their mouth, nose, and eyes. This method of self-inoculation is due to the failure of the isolation gowns to maintain critical zone A coverage.

It is with these observations in mind, among others, that the presently disclosed technology was conceived.

BRIEF SUMMARY

The aforementioned problems can be addressed using the systems, methods, and devices disclosed herein. In some instances, a medical gown for protecting a user includes a body portion; a neckline defined around a top of the body portion; and a neck protector extending from the neckline to cover a front area of a neck region of the user during use of the medical gown. The neck protector can include a shielding strip to wrap around the neck region of the user; and a partial front coupling of the shielding strip to a front of the neckline (e.g., only a partial front coupling with separation gaps on either side).

In some examples, the partial front coupling is inset a predefined distance from a first shoulder edge of the neckline and a second shoulder edge of the neckline. Additionally, a neck gap can be formed between a bottom edge of the shielding strip and the neckline. The neck gap can include a first gap formed between the first shoulder edge of the neckline and the shielding strip; and a second gap formed between the second shoulder edge of the neckline and the shielding strip. Furthermore, the neck gap between the bottom edge of the shielding strip and the neckline can extend fully around a rear of the neck protector.

In some instances, the partial front coupling of the shielding strip is at a center front of the neckline and terminates at a first side front end of the neckline and at a second side front edge of the neckline. The neck protector can also include one or more rear positioning mechanism for securing the shielding strip around a front area of the neck region. The one or more rear positioning mechanism can include a first extension of the shielding strip to be tied with a second extension of the shielding strip at a rear portion of the neck region. Moreover, the one or more rear positioning mechanism can include one or more adhesive strips to secure a first end of the shielding strip to a second end of the shielding strip. In some scenarios, the one or more rear positioning mechanism includes one or more clips to secure a first end of the shielding strip to a second end of the shielding strip. Additionally, or alternatively, the one or more rear positioning mechanism includes a string, extending from a first end or a second end of the shielding strip, to secure the first end to the second end.

Furthermore, in some scenarios, the body portion is formed of a fabric material or a plastic material; and the shielding strip is formed of the fabric material or the plastic material continuous with body portion at the partial front coupling (e.g., omitting any seams or additional features between the shielding strip and the body portion). Additionally, the neck protector can maintain gown coverage over critical zone A, as defined by Association for the Advancement of Medical Instrumentation (AAMI) standards, during use.

In some examples, a method of manufacturing a medical gown for protecting a user includes forming a body portion from an unwoven material, a top of the body portion defining a neckline; and forming a neck protector that extends from a front of the neckline, the neck protector operable to cover a front area of a neck region during use of the medical gown, the neck protector partially coupling to the front of the neckline such that a first gap is formed at a first side of the front of the neckline and a second gap is formed at a second side of the front of the neckline.

In some instances, the neck protector is formed of the unwoven material such that the neck protector is a continuous extension of material forming the body portion. Furthermore, a coupling width of the neck protector to the body portion, defined between the first gap and the second gap, can have a distance in a range of two inches and six inches. The method can also include forming one or more positioning mechanism into the neck protector for securing the neck protector around the neck region. Additionally, or alternatively, the one or more positioning mechanism includes at least one of: a first neck protector extension operable to be tied with a second neck protector extension; or one or more adhesive strips or hook-and-loop strips for securing a first portion of the neck protector to a second portion of the neck protector. Moreover, the method can include forming one or more gown closure straps into the neckline, the one or more gown closure straps operable to close a rear opening of the medical gown via a knot formed by the one or more gown closure straps below the one or more positioning mechanism.

In some examples, a medical gown for protecting a user includes a body portion; a neckline defined around a top opening of the body portion; and a neck protector extending from the neckline to cover a front area of the user during use of the medical gown. The neck protector can include a shielding strip extending from a front of the neckline to wrap around a neck region of the user. The medical gown can also include a neck gap between a bottom edge of the neck protector and a top edge of the neckline, the neck gap extending around a back of the medical gown and partially around a front of the medical gown.

The foregoing summary is intended to be illustrative and is not meant in a limiting sense. Many features of the embodiments may be employed with or without reference to other features of any of the embodiments. Additional aspects, advantages, and/or utilities of the presently disclosed technology will be set forth in part in the description that follows and, in part, will be apparent from the description, or may be learned by practice of the presently disclosed technology.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the disclosed subject matter. It should be understood, however, that the disclosed subject matter is not limited to the precise embodiments and features shown. The accompanying drawings, which are incorporated in and constitute a part of this specification, illustrate an implementation of systems, methods, and devices consistent with the disclosed subject matter and, together with the description, serves to explain advantages and principles consistent with the disclosed subject matter, in which.

DETAILED DESCRIPTION

Figure 1:
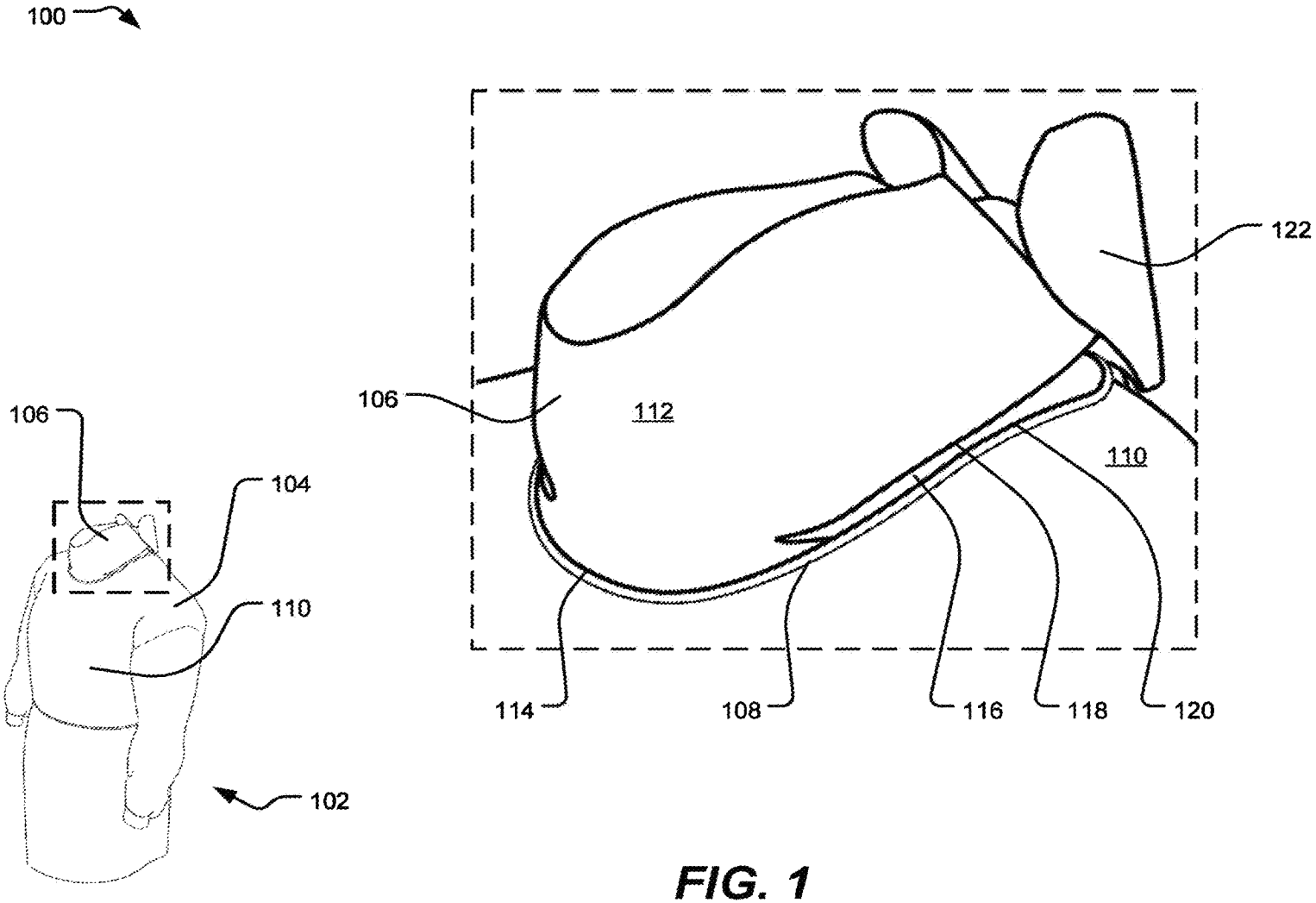
FIG. 1 is a perspective view illustrating an example system including a personal protection gown with a neck protector that provides frontal protection for a user.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail or have been omitted from the drawings so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "above," "below," "down," "up," and "side," are used in the description for clarity in specific reference to the figures and are not intended to limit the scope of the presently disclosed technology or the appended claims. Further, it should be understood that any one of the features of the presently disclosed technology may be used separately or in combination with other features. Other systems, methods, features, and advantages of the presently disclosed technology will be, or become, apparent to one with skill in the art upon examination of the figures and the detailed description. It is intended that all such additional systems, methods, features, and advantages be included within this description, be within the scope of the presently disclosed technology, and be protected by the accompanying claims.

Further, as the presently disclosed technology is susceptible to embodiments of many different forms, it is intended that the present disclosure be considered as an example of the principles of the presently disclosed technology and not intended to limit the presently disclosed technology to the specific embodiments shown and described. Any one of the features of the presently disclosed technology may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments but is not necessarily included. Thus, the presently disclosed technology may include a variety of combinations and/or integrations of the embodiments described herein. Additionally, all aspects of the present disclosure, as described herein, are not essential for its practice. Likewise, other systems, methods, features, and advantages of the presently disclosed technology will be, or become, apparent to one with skill in the art upon examination of the figures and the description.

Any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

The term "coupled" is defined as connected, whether directly or indirectly through intervening components, or without intervening components. The connection can be such that the objects are permanently connected or releasably connected. The terms "comprising," "including" and "having" are used interchangeably in this disclosure. The terms "comprising," "including" and "having" mean to include, but not necessarily be limited to the things so described.

Lastly, the terms "or" and "and/or," as used herein, are to be interpreted as inclusive or meaning any one or any combination. Therefore, "A, B, or C" or "A, B, and/or C" mean any of the following: "A," "B," or "C"; "A and B"; "A and C"; "B and C"; "A, B and C." An exception to this definition will occur only when a combination of elements, functions, steps or acts are in some way inherently mutually exclusive.

II. General Architecture

As noted above, some gowns worn by healthcare workers gape open at the neckline and sag down while the healthcare workers care for their patients, exposing the wearer's upper torso to contamination with infectious microorganisms and, thus, creating a source of transmission of infection. Systems, methods, and devices disclosed herein address the aforementioned issues by providing a personal protection gown with a neck protector extending up from a front neckline of the gown. The neck protector material can extend a predefined distance such that it avoids interfering with any facial coverings, such as masks. Additionally, the neck protector material can be an extension of the front of the gown rather than a separate piece of material. The material extending up the neck can be attached only to a portion of the front of the gown creating a separation gap. This separation of the neck material from the rest of the gown (except for the portion connecting in the front) can make the gown more form fitting and provide a more secure closure than other gown designs.

In some instances, the neck material is part of the front of the gown and does not change or interfere with how the gown is donned, such that the design can be incorporated into gowns that are donned by being pulling on from the front or over the head. From the segment extending up from the torso of the gown, the neck material can continue in strips on either side. The neck material can be closed at the back of the neck by either tying the two strips of material together or using another method of closure, such as adhesive. The strip of material can be the same height as the neck material in front or can taper to a lower height. The ends can be tied to establish a proper level of comfort for the user. If the closure feels uncomfortable, the knot formed by the ends can be loosened. The gown can fit comfortably around the neck and settle no further down than at the base of the neck. The closure of the neck protector can be an additional closure for gowns that are donned from the front, which can still include the closure straps at the top of the torso.

In some examples, the material of the gown can be any of the materials currently used for disposable, non-surgical gowns. The extended neck material can be part of the gown and can be manufactured as one gown, using various methods of assembly, including thermal, chemical, or mechanical seaming. The neck material can add only a few inches of added material such that manufacturing costs are not significantly increased.

In some scenarios, materials used to form the neck extension can also be easily pulled apart by the wearer when the gown is being removed. The materials currently used for disposable, non-surgical gowns have a tensile strength low enough to allow them to be torn off by the wearer with little effort, alleviating concerns of any potential choking or strangulation risks when using a closure around the neck. If, at any time, the gown becomes caught in something causing it to pull strongly against the wearer, the material around the neck (and body) tears away.

In some instances, incorporating the extended neck material with the rear closure design into disposable, non-surgical gowns ensures that critical zone A remains protected and covered, even when the wearer is bending forward or moving about. Critical zone A also remains protected for one-size-fits all gowns, and/or gowns that are hastily donned using the technology disclosed herein.

As such, the gown provides real-world critical zone A coverage while meeting various preset parameters to ensure incorporation into the current disposable gown manufacturing industry. Solutions disclosed herein can work with mass-produced, one-size-fits-all gowns and may be incorporated with gowns donned from the front as well as those pulled on over the head. The solution can work with current materials used for disposable, non-surgical gowns (mainly polypropylene, polyester, or polyethylene) and/or those assembled using thermal, chemical, or mechanical seaming.

The technology disclosed herein can increase protection and safety for all wearers, regardless of their size or the fit of the gown. Moreover, the disclosed technology does not substantially increase the cost to manufacture the gowns.

Additional benefits and advantages of the disclosed technology will become apparent from the detailed description below.

FIG. 1 illustrates an example system 100 including a gown 102, such as a personal protection gown 104, with frontal coverage. The frontal coverage can be provided by a neck protector 106 that extends from a neckline 108 of a body portion 110 of the personal protection gown 104. The neck protector 106 can include a shielding strip 112 that wraps around a neck region of a user wearing the personal protection gown 104. Furthermore, the neck protector 106 can have a front partial coupling 114 to the body portion 110 so that a neck gap 116 is formed between a bottom edge 118 of the shielding strip 112 and an edge 120 of the neckline 108. Furthermore, in some instances, the shielding strip 112 includes one or more extension straps 122 that can be pulled back around the neck of the user and tied in a knot behind the neck of the user. As such, the neck protector 106 can be secured in place and can hold up the body portion 110 such that the body portion 110 is prevented from falling or sliding down around the neck region of the user. Additionally, the personal protection gown 104 can be usable with a variety of different body shapes and sizes, with the front partial coupling 114 providing flexibility for pulling the shielding strip 112 as tightly as needed without cinching the neckline 108.

Figure 2:
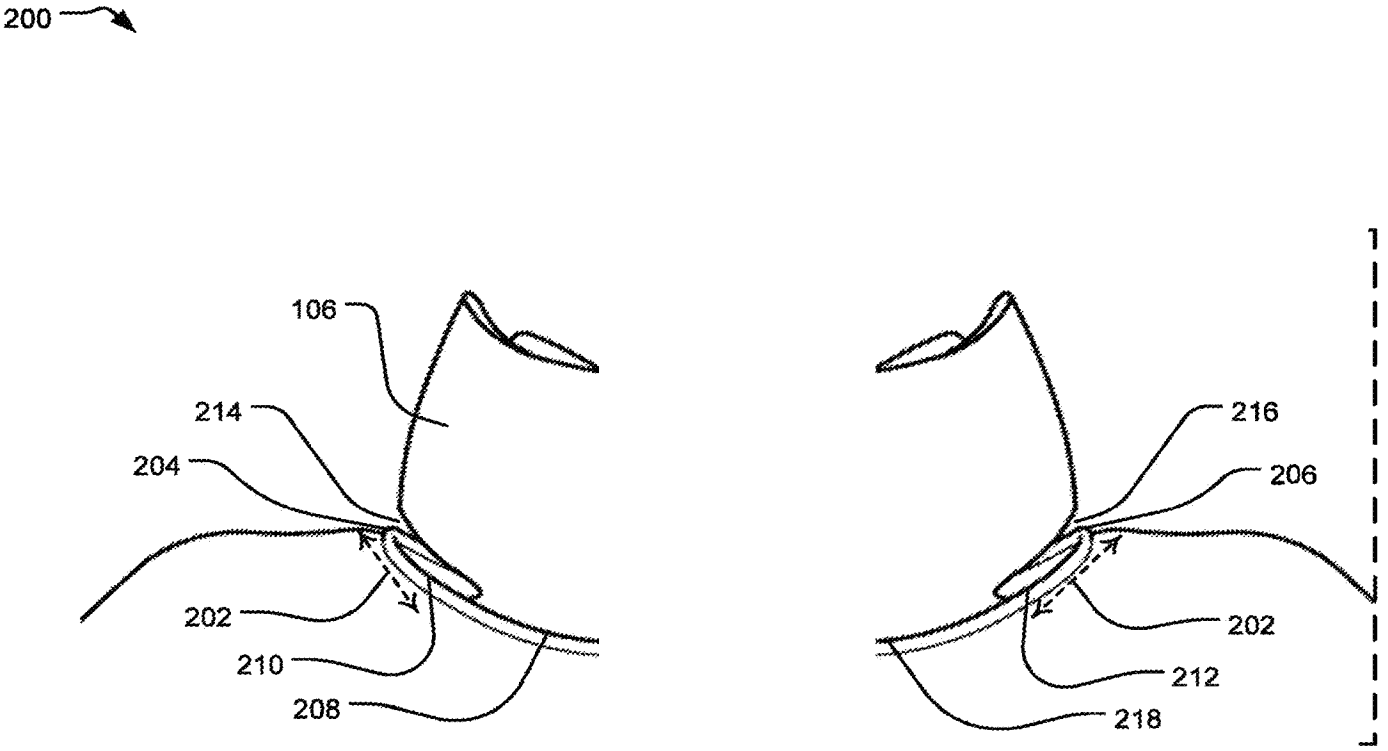
FIG. 2 is a front view illustrating an example system including a personal protection gown with a neck protector having a front partial coupling with a body portion, which can form at least a portion of the system depicted in FIG. 1.

FIG. 2 illustrates an example system 200 including the personal protection gown 104, which can form at least a portion of the system 100 depicted in FIG. 1. The personal protection gown 104 can include the front partial coupling 114, as discussed in greater detail below.

In some instances, the personal protection gown 104 includes the front partial coupling 114 of the neck protector 106 to the body portion 110. The front partial coupling 114 can be a portion of the neckline 108 from which the neck protector 106 extends and/or to which the neck protector 106 adjoins, couples, attaches, and so forth. For instance, the front partial coupling 114 can be a continuous portion of the fabric or material connecting the body portion 110 and the neck protector 106. In other words, the personal protection gown can be manufactured by coupling the neck protector 106 to the body portion 110 at the front partial coupling 114, or by cutting both the neck protector 106 and the body portion 110 from a single material or fabric such that the front partial coupling 114 omits any seam and/or is formed of the continuous material of the body portion 110 and the neck protector 106.

In some examples, the front partial coupling 114 is inset a predefined distance 202 from a first shoulder edge 204 of the neckline and a second shoulder edge 206 of the neckline 108. The first shoulder edge 204 and/or the second shoulder edge 206 can be defined as one or more center line(s) of the personal protection gown (e.g., as seen from a top view) that divides a front of the personal protection gown 104 from a back of the personal protection personal protection gown 104. As such, the front partial coupling 114 of the neck protector 106 to the body portion 110 can form only a partial coupling at a front edge 208 of the neckline 108. Put another way, a first side portion 210 of the front edge 208 can omit any coupling to the neck protector 106 (e.g., for the predefined distance 202), and a second side portion 212 of the front edge 208 can omit any coupling to the neck protector 106 (e.g., for the predefined distance 202).

In some scenarios, a cut-out of material extending the predefined distance 202 can define a front boundary (e.g., a beginning and/or end) of the neck gap 116 at the front edge 208 of the neckline 108. For instance, the neck gap 116 can include a first gap 214 formed between the first side portion 210 of the front edge 208 of the neckline 108 (e.g., and/or the first shoulder edge 204) and the bottom edge 118 of the shielding strip 112. The neck gap 116 can also include a second gap 216 formed between the second side portion 212 of the front edge 208 of the neckline 108 (e.g., and/or the second shoulder edge 206) and the bottom edge 118 of the shielding strip 112. The front partial coupling 114 can be disposed between the first gap 214 and the second gap 216 at the front edge 208, for instance, at a center front edge 218 of the neckline 108. The center front edge 218 including the front partial coupling 114 can have a center coupling width distance, such as one inch, two inches, three inches, four inches, five inches, six inches, seven inches, eight inches, and/or a range of distances, such as between two inches and six inches, between one inch and ten inches, and so forth. Furthermore, in some scenarios the first gap 214 can extend all the way around a rear of the neck protector 106, forming a rear gap, which can transition back around and into the second gap 216. In other words, the first gap 214, the rear gap, and the second gap 216 can be a continuous gap encircling a majority of the neckline 108 except the front portion of the neckline 108 including the front partial coupling 114. Additionally, the material forming the shielding strip 112 can have a height dimension, such as two inches, three inches, four inches, five inches, six inches, seven inches, eight inches, and the like.

In some examples, the personal protection gown 104 can be a surgical gown, a surgical isolation gown, a non-surgical isolation gown, or so forth, as defined by FDA. For instance, the personal protection gown 104 can be a non-surgical isolation gown with a critical zone A 220 defined as a front torso region of the personal protection gown 104, extending up to the neckline 108. By using positioning mechanisms to secure the neck protector 106 in place around the neck of the wearer, the critical zone A 220 can be held upright and prevented from sagging in real world settings, for instance, when a user leans over. As such, the personal protection gown 104 can be prevented from gaping open in the front and exposing the wearer's upper torso, neck, and/or chest. Moreover, in some instances, the personal protection gown 104 is a disposable gown made of a low-cost plastic, fabric, or nonwoven material such as polypropylene, polyester, or polyethylene. Rather than sewn, the garments can be assembled using thermal, chemical, or mechanical seaming. In some instances. The personal protection gown 104 can be of a first style with a back opening, such that the personal protection gown 104 is pulled on in front. Additionally, or alternatively, the personal protection gown 104 can be of a second style omitting any back opening, such that the personal protection gown 104 is pulled over the head of a user.

Figure 3:
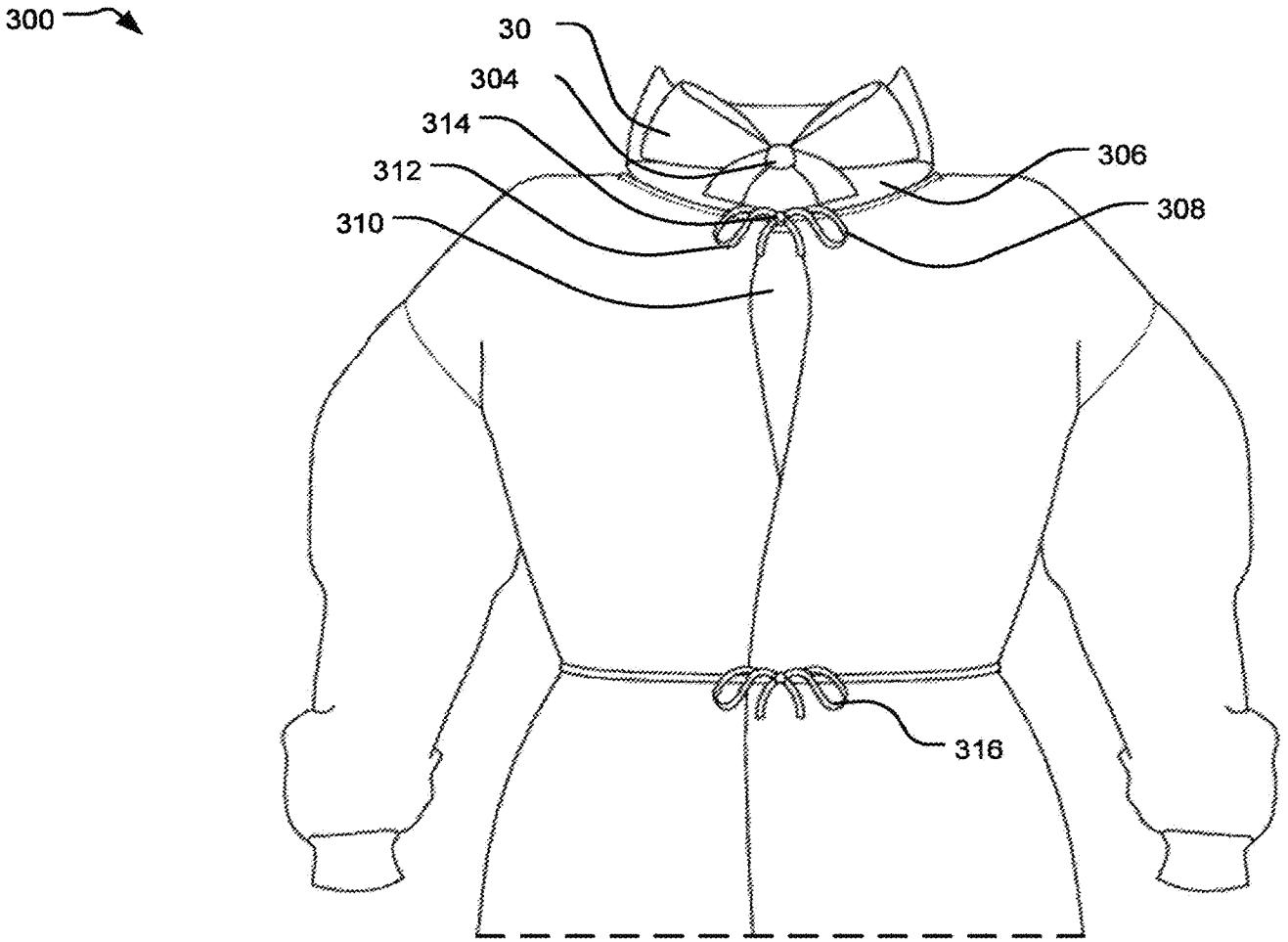
FIG. 3 is a rear view illustrating an example system including a personal protection gown with a neck protector having one or more positioning mechanisms, which can form at least a portion of the system depicted in FIG. 1.

FIG. 3 illustrates an example system 300 including the personal protection gown 104, which can form at least a portion of the system 100 depicted in FIG. 1. The personal protection gown 104 can include one or more positioning mechanism 302 for securing the neck protector 106 in place, as discussed in greater detail below.

In some examples, the personal protection gown 104 includes one or more positioning mechanisms 302 to secure the neck protector 106 in place on the user. For instance, the neck protector 106 itself can include the strap extension(s) 122, which can be wrapped around the neck and tied into a knot 304 and/or loop behind the neck. As shown in FIG. 3, the neck protector 106 can be separated from the body portion 110 by a rear gap 306 that extends fully around the rear of the neck and the shoulders up to the front partial coupling 114.

Furthermore, the personal protection gown 104 can include one or more gown closure straps 308 for closing a rear opening 310 of the personal protection gown 104. The one or more gown closure straps 308 can include a first set of gown closure straps 312 hemmed into the neckline 108 below the neck protector 106, which can be tied into a second knot 314 below the first knot 304 of the neck protector 106. Moreover, the personal protection gown 104 can include a second set of gown closure straps 316 disposed around a waist of the personal protection gown.

Figure 4:
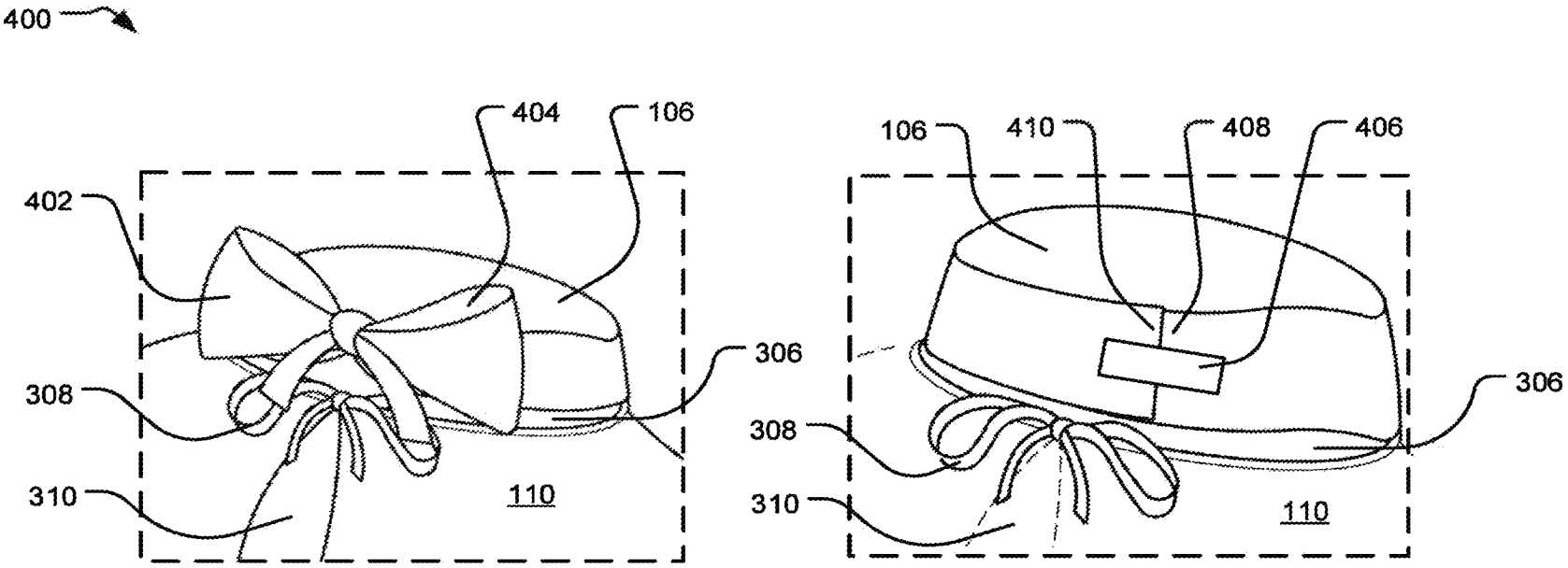
FIG. 4 is a plurality of rear perspective views illustrating an example system including a personal protection gown having various configurations of positioning mechanisms, which can form at least a portion of the system depicted in FIG. 1.

FIG. 4 illustrates an example system 400 including the personal protection gown 104, which can form at least a portion of the system 100 depicted in FIG. 1. The personal protection gown 104 can include various configurations of the positioning mechanism(s) 302, as discussed in greater detail below.

In some examples, as noted above, the positioning mechanism(s) 302 can include the knot 304 tied by the extension straps 122. For instance, a first extension strip 402 of the shielding strip 112 can extend from a first side of the neck protector 106 and a second extension strip 404 can extend from a second side of the neck protector 106, both extension strips wrapping around the neck and meeting at a rear of the neck where they can be tied together to form the knot 304. Additionally, or alternatively, the positioning mechanism(s) 302 can include one or more adhesive strips 406 (e.g., one, two, three, etc.) to secure a first end 408 of the shielding strip 112 to a second end 410 of the shielding strip 112. Moreover, the positioning mechanism(s) 302 can include one or more clips, hooks, pins, buttons, strings, straps, hook-and-loop strips, combinations thereof, and the like.

Figure 5:
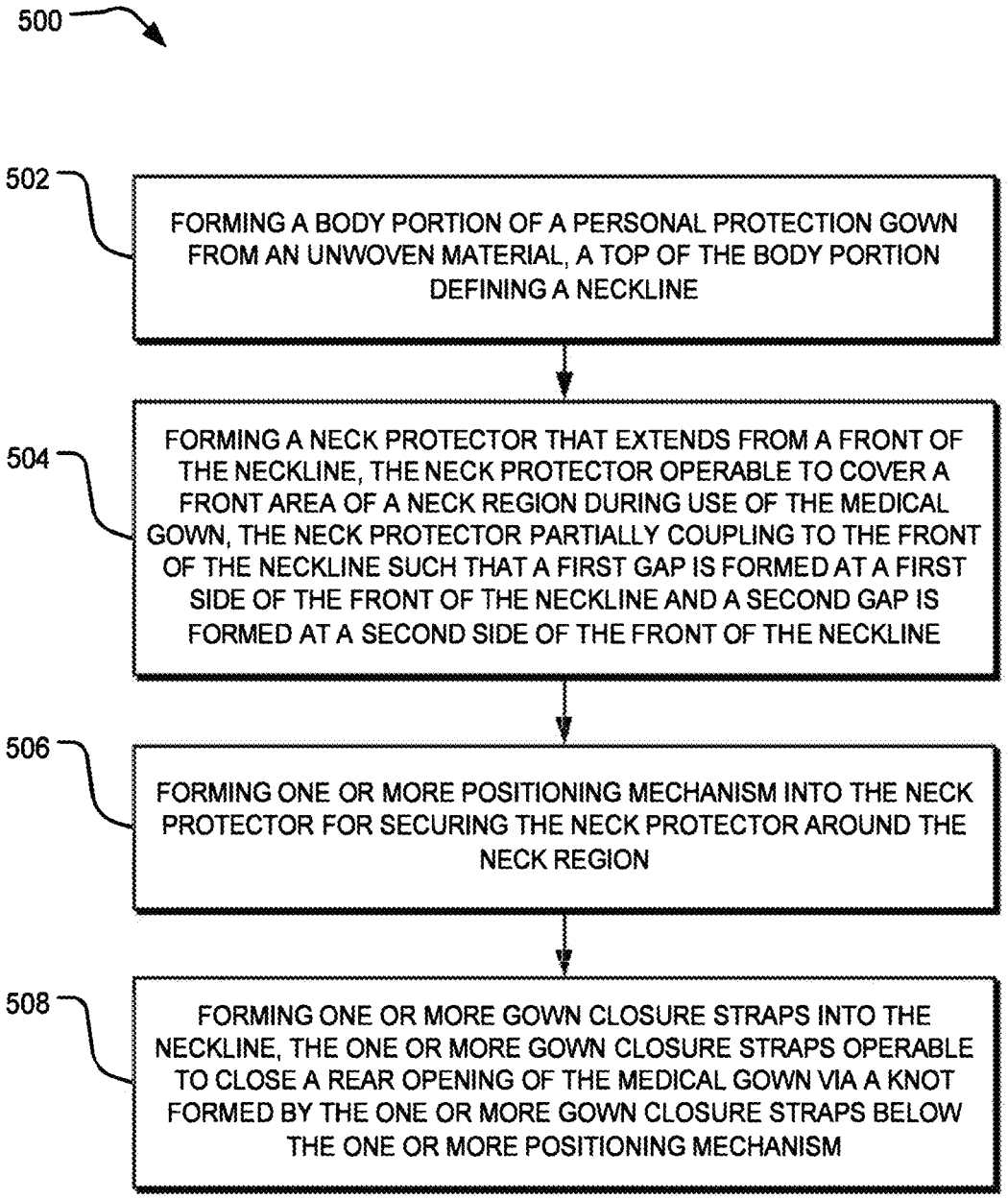
FIG. 5 is a block diagram illustrating a method for manufacturing a personal protection gown with a neck protector that provides frontal protection for a user, which can include the systems depicted in FIGS. 1-4.

FIG. 5 illustrates an example method 500 for manufacturing the personal protection gown 104 depicted in the systems 100-400 depicted in FIGS. 1-4.

In some examples, at operation 502, the method 500 forms a body portion of a personal protection gown from an unwoven material, a top of the body portion defining a neckline. At operation 504, the method 500 can form a neck protector that extends from a front of the neckline, the neck protector operable to cover a front area of a neck region during use of the medical gown, the neck protector partially coupling to the front of the neckline such that a first gap is formed at a first side of the front of the neckline and a second gap is formed at a second side of the front of the neckline. At operation 506, the method 500 can form one or more positioning mechanism into the neck protector for securing the neck protector around the neck region. At operation 508, the method 500 can form one or more gown closure straps into the neckline, the one or more gown closure straps operable to close a rear opening of the medical gown via a knot formed by the one or more gown closure straps below the one or more positioning mechanism.

It is to be understood that the specific order or hierarchy of steps in the method(s) 500 depicted in FIG. 5 and throughout this disclosure are instances of example approaches and can be rearranged while remaining within the disclosed subject matter. For instance, any of the operations depicted in FIG. 5 and throughout this disclosure may be omitted, repeated, performed in parallel, performed in a different order, and/or combined with any other of the operations depicted in FIG. 5 and throughout this disclosure.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined differently in various implementations of the disclosure or described with different terminology. These and other variations, modifications, additions, and improvements may fall within the scope of the disclosure as defined in the claims that follow.

The invention claimed is:

1. A medical gown for protecting a user, the medical gown comprising:

a body portion comprising a front, a back, a first shoulder region, and a second shoulder region;

a neckline comprising a top opening, the neckline defining a top of the body portion adjacent the first shoulder region and adjacent the second shoulder region; and a neck protector extending from the neckline at the front of the body portion, the neck protector including:

a shielding strip comprising a bottom edge, wherein the shielding strip forms a neck gap presenting a distance between the bottom edge and at least a portion of the neckline, wherein the distance between the bottom edge and the neckline is constant from the front of the body portion to the back of the body portion; and a partial front coupling connecting the shielding strip to the neckline at the front of the body portion, wherein the neck gap extends from the partial front coupling around to the back of the body portion above the first shoulder region and the second shoulder region.

2. The medical gown of claim 1, wherein the shielding strip comprises a first extension extending from the partial front coupling above the first shoulder region and a second extension extending from the partial front coupling above the second shoulder region.

3. The medical gown of claim 2, further comprising at least one fastener configured to attach the first extension to the second extension.

4. The medical gown of claim 3, wherein the at least one fastener is one or more adhesive strips.

5. The medical gown of claim 3, wherein the at least one fastener comprises a first fastener and a second fastener.

6. The medical gown of claim 5, wherein the first fastener is integrally formed from the first extension and the second fastener is integrally formed from the second extension.

7. The medical gown of claim 6, wherein the first fastener is configured to couple to the second fastener at the back of the body portion.

8. The medical gown of claim 7, wherein the first fastener and the second fastener are configured to be tied or clipped together.

9. The medical gown of claim 1, wherein the body portion is formed of a fabric material or a plastic material configured to be torn away from a body of the user after being used; and the shielding strip is formed of the fabric material or the plastic material continuous with the body portion at the partial front coupling.

10. The medical gown of claim 1, wherein the neck protector maintains gown coverage as defined by the Food and Drug Administration.

11. A medical gown for protecting a user, the medical gown comprising:

a body portion comprising a front, a back, a first shoulder region, and a second shoulder region;

a neckline comprising a top opening, the neckline defining a top of the body portion adjacent the first shoulder region and adjacent the second shoulder region and extending 360 degrees around the body portion; and a neck protector extending from the neckline at the front of the body portion, the neck protector including:

a shielding strip comprising a bottom edge, wherein the shielding strip forms a neck gap presenting a distance between the bottom edge and the neckline, wherein the distance between the bottom edge and the neckline is constant from the front of the body portion to the back of the body portion; and a partial front coupling connecting the shielding strip to the neckline at the front of the body portion, wherein the neck gap extends from the partial front coupling fully around the back of the body portion above the first shoulder region and the second shoulder region.

12. The medical gown of claim 11, wherein the partial front coupling is positioned at a center front of the neckline and terminates at a first side front edge of the neckline and at a second side front edge of the neckline, and wherein the neck gap extends from the first side front edge to the second side front edge.

13. The medical gown of claim 11, wherein the body portion comprises an unwoven material, and wherein the neck protector is formed of the unwoven material such that the neck protector is a continuous extension of material forming the body portion.

14. The medical gown of claim 11, further comprising a first extension of the shielding strip configured to be coupled to a second extension of the shielding strip above the back, the front, the first shoulder region, or the second shoulder region.

15. The medical gown of claim 14, further comprising a first fastener coupled to the first extension and a second fastener coupled to the second extension, wherein the first fastener is configured to couple to the second fastener above the back of the body portion.

16. The medical gown of claim 14, further comprising one or more adhesive strips coupling the first extension to the second extension.

17. A medical gown for protecting a user, the medical gown comprising:

a body portion comprising a front, a back, a first shoulder region, and a second shoulder region, wherein a top of the body portion is defined by a neckline; and a neck protector extending from the front of the body portion, the neck protector including a shielding strip extending 360 degrees around the body portion above the front, the back, the first shoulder region, and the second shoulder region, and providing a neck gap presenting a distance between the shielding strip and the neckline, wherein the distance between a bottom edge of the neck protector and the neckline is constant from the front of the body portion to the back of the body portion, wherein the neck protector forms a rear gap configured to be coupled at the back of the body portion.

18. The medical gown of claim 17, wherein the rear gap is coupled by one or more adhesive strips.

19. The medical gown of claim 17, further comprising a partial front coupling connecting the shielding strip to the neckline at the front of the body portion, wherein the neck protector further comprises a first extension extending from a first edge of the partial front coupling and a second extension extending from a second edge of the partial front coupling, and wherein the first extension and the second extension are configured to be coupled by adhesive strips, hook-and-loop strips, strings, or clips.

20. The medical gown of claim 19, wherein the body portion comprises an unwoven material, wherein the neck protector is formed of the unwoven material such that the neck protector is a continuous extension of material forming the body portion, wherein the body portion is configured to be torn away, and wherein the neck protector maintains gown coverage as defined by the Food and Drug Administration.

* * * * *